US010442093B2

(12) United States Patent
Jacobs et al.

(10) Patent No.: US 10,442,093 B2
(45) Date of Patent: Oct. 15, 2019

(54) SAFETY UTILITY BLADES, ASSEMBLIES AND METHODS OF MANUFACTURING

(71) Applicant: KLEVER KUTTER LLC, Grand Haven, MI (US)

(72) Inventors: Matthew Jacobs, Grand Haven, MI (US); Jeffrey Kempker, Muskegon, MI (US); Orville Crain, Muskegon, MI (US)

( * ) Notice: Subject to any disclaimer, the term of this patent is extended or adjusted under 35 U.S.C. 154(b) by 1635 days.

(21) Appl. No.: 13/866,074

(22) Filed: Apr. 19, 2013

(65) Prior Publication Data

US 2013/0298409 A1 Nov. 14, 2013

Related U.S. Application Data

(63) Continuation-in-part of application No. 12/620,999, filed on Nov. 18, 2009, now abandoned.

(51) Int. Cl.

| | |
|---|---|
| ***B26B 5/00*** | (2006.01) |
| ***B26B 9/00*** | (2006.01) |
| ***B25F 1/02*** | (2006.01) |
| ***B25G 1/10*** | (2006.01) |
| ***B25G 3/18*** | (2006.01) |
| ***B26B 25/00*** | (2006.01) |
| ***B26B 27/00*** | (2006.01) |

(52) U.S. Cl.

CPC ..... *B26B 5/00* (2013.01); *B25F 1/02* (2013.01); *B25G 1/102* (2013.01); *B25G 3/18* (2013.01); *B26B 9/00* (2013.01); *B26B 25/005* (2013.01); *B26B 27/005* (2013.01)

(58) Field of Classification Search

CPC .. B26B 5/00; B26B 5/005; B26B 9/00; B26B 9/02; Y10T 83/04

USPC ..... 30/314, 348, 337, 2, 164, 280, 317; 76/104.1

See application file for complete search history.

(56) References Cited

U.S. PATENT DOCUMENTS

| | | | | |
|---|---|---|---|---|
| 1,553,449 A | | 9/1925 | Kennedy | |
| 1,777,029 A | * | 9/1930 | Bradford | A01B 1/08 172/381 |
| 1,928,187 A | * | 9/1933 | Radel | E04D 15/04 30/299 |
| 2,254,199 A | | 9/1941 | Baltuch | |
| 2,274,978 A | | 3/1942 | Currier | |
| 2,840,903 A | | 7/1958 | Christensen | |
| 3,178,812 A | | 4/1965 | Lurie | |
| 3,324,548 A | * | 6/1967 | Mascia | B25G 1/08 30/125 |
| 3,972,117 A | * | 8/1976 | Fogg | B26B 27/00 30/287 |
| 4,167,810 A | | 9/1979 | Gilbert | |

(Continued)

*Primary Examiner* — Phong H Nguyen
(74) *Attorney, Agent, or Firm* — James E. Shultz, Jr.

(57) ABSTRACT

A safety blade for use with a knife assembly having a handle with a cutting head engagement portion, the safety bade comprising (a) a blade body, a bade attachment having a first inner edge and a second inner edge, a first blade shield, a second blade shield, a first blade cutting edge, and a second blade cutting edge, and (b) a handle adaptor having a body portion and a handle engagement portion with a handle securing mechanism. The first blade cutting edge is positioned between the first blade shield and the first inner edge, and the second blade cutting edge is positioned between the second blade shield and the second inner edge.

7 Claims, 15 Drawing Sheets

(56) References Cited

U.S. PATENT DOCUMENTS

| | | | | |
|---|---|---|---|---|
| 4,433,484 | A | 2/1984 | Antisdel | |
| 4,744,146 | A | 5/1988 | Schmidt | |
| 5,036,591 | A | 8/1991 | Cousins | |
| 5,282,316 | A | 2/1994 | Anderson | |
| 5,412,871 | A * | 5/1995 | Reyburn | B26B 27/005 30/2 |
| 5,561,905 | A | 10/1996 | Sherman | |
| 5,720,105 | A | 2/1998 | Gates | |
| D400,412 | S | 11/1998 | Gold | |
| D401,492 | S | 11/1998 | Joseph | |
| 5,852,874 | A | 12/1998 | Walker | |
| D407,277 | S | 3/1999 | Cousins | |
| 5,933,918 | A | 8/1999 | Wallays | |
| 6,035,534 | A | 3/2000 | Abbott | |
| 6,513,249 | B2 * | 2/2003 | Linton | B26B 3/04 30/2 |
| 6,544,277 | B1 | 4/2003 | O'Heeron | |
| 6,637,112 | B2 | 10/2003 | Davis | |
| 6,823,593 | B2 | 11/2004 | Dunn-Rankin | |
| 6,895,674 | B2 | 5/2005 | Ai | |
| D521,844 | S | 5/2006 | Kempker | |
| D527,604 | S | 9/2006 | Kempker | |
| 7,367,876 | B1 * | 5/2008 | Denoff | A22C 29/024 452/2 |
| D580,241 | S | 11/2008 | Fraga | |
| 7,533,595 | B2 | 5/2009 | Domenico | |
| D603,232 | S | 11/2009 | Gutowski | |
| D605,005 | S | 12/2009 | Benson | |
| D639,631 | S | 6/2011 | Kempker | |
| 7,958,639 | B2 | 6/2011 | Ireland | |
| 2007/0245574 | A1 * | 10/2007 | Green | B26B 9/00 30/346.5 |
| 2007/0272061 | A1 | 11/2007 | Hsieh | |

* cited by examiner

SAFETY UTILITY BLADES, ASSEMBLIES AND METHODS OF MANUFACTURING

RELATED APPLICATIONS

This application is a continuation-in-part of U.S. patent application Ser. No. 12/620,999, which was filed on Nov. 18, 2009. The entire disclosure of which is incorporated herein by reference.

FIELD OF THE INVENTION

The present disclosure relates to safety blades for use in utility knives, related assemblies and methods of manufacturing. More specifically, the present disclosure relates to safety blades for use in utility knives, related assemblies and methods of manufacture which limit user exposure to associated cutting edges.

BACKGROUND

Utility knives are used for a host of purposes, such as opening cardboard boxes, cutting sheet material, cutting web material, opening packages, etc. Injuries to the users of utility knifes are all too common due to inadvertent contact with the cutting edges of the associated blades. Injuries may be particularly severe when the given utility knife includes a razor blade.

Inadvertent contact with the cutting edges of blades can be equally common during blade removal, insertion and handling. Inadvertent contact with the cutting edges is particularly problematic when a user is removing or inserting a double edge razor blade into an associated utility knife.

Blades for use in utility knives and utility knives which limit user exposure to the associated cutting edges are desirable. Methods of manufacturing related blades and utility knives are also desirable.

SUMMARY

A safety blade for use within a utility knife includes a blade body, a blade attachment, a first blade shield and a second blade shield, wherein the blade body, the blade attachment, the first blade shield and the second blade shield compose a contiguous piece of metal. The blade attachment comprises a first inner surface and a second inner surface juxtapose on opposing edges of the blade attachment, where a thickness of the first inner surface is greater than a thickness of the first blade cutting edge and less than or substantially equal to a thickness of the blade body and a thickness of the second inner surface is greater than a thickness of the second blade cutting edge and less than or substantially equal to the thickness of the blade body. The first blade shield and the first inner surface of the blade attachment form a first blade throat which limits exposure to a first blade cutting edge, wherein the first blade shield comprises a first blunt tip having a first inner edge with a thickness that is greater than a thickness of the first blade cutting edge and less than or substantially equal to the thickness of the blade body and wherein the first inner surface of the blade attachment and the first inner edge of the first blunt tip extend beyond the first blade cutting edge. The second blade shield and the second inner surface of the blade attachment form a second blade throat which limits exposure to a second blade cutting edge, wherein the second blade shield comprises a second blunt tip having a thickness that is greater than a thickness of the second blade cutting edge and less than or substantially equal to the thickness of the blade body and wherein the second inner surface of the blade attachment and the second inner edge of the second blunt tip extend beyond the second blade cutting edge.

In another embodiment, a method of manufacturing a safety blade for use within a safety utility knife assembly includes providing a strip of blade material and forming a rough blade shape from the strip of blade material, wherein the rough blade shape comprises a blade body, a blade attachment with an inner surface and a blade shield. The method also includes forming a blade cutting edge in the rough blade shape, wherein the blade shield and the inner surface of the blade attachment form a blade throat which limits exposure to the blade cutting edge and wherein the blade shield comprises a blunt tip having an inner edge with a thickness that is greater than a thickness of the blade cutting edge and less than or substantially equal to a thickness of the blade body and wherein the inner surface of the blade attachment extends beyond a heel of the blade cutting edge and the inner edge of the blunt tip extends beyond a toe of the blade cutting edge.

In a further embodiment, a safety utility knife assembly includes a blade having a predetermined thickness and a cutting edge. The safety utility knife further includes a blade holder, wherein an operative end of the blade holder is offset from a blade holder section of the blade holder by a distance substantially equal to the predetermined thickness of the blade and wherein the operative end of the blade holder includes a blade throat that limits exposure to the cutting edge of the blade.

The features and advantages described in this summary and the following detailed description are not all-inclusive. Many additional features and advantages will be apparent to one of ordinary skill in the art in view of the drawings, specification, and claims hereof.

DETAILED DESCRIPTION

The safety utility blades and safety utility knife assemblies of the present disclosure incorporate various features that limit user exposure to associated cutting edges. The manufacturing methods of the present disclosure may be used to produce the disclosed safety utility blades and safety utility knife assemblies.

Figure 1A:
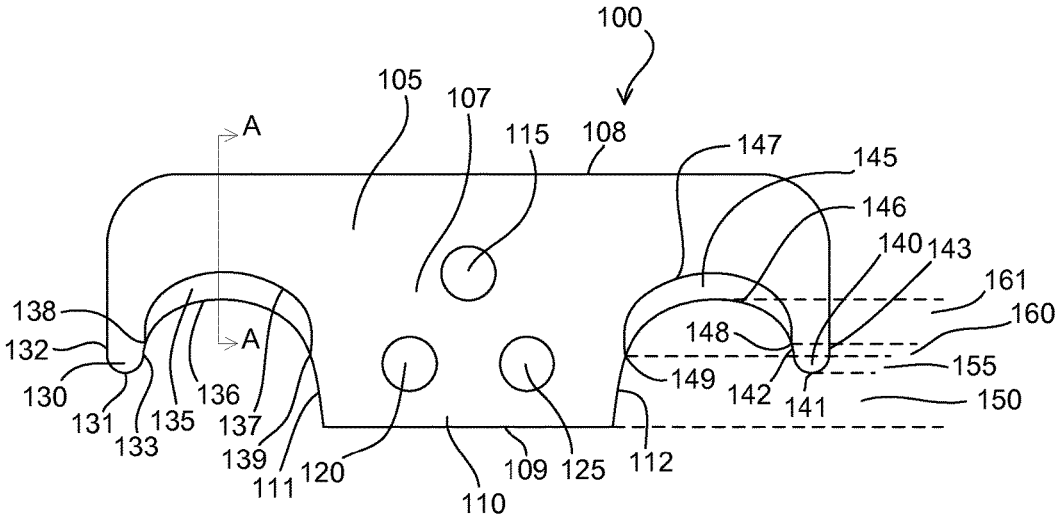
FIGS. 1*a* and 1*b* depict an example safety utility blade for use within a utility knife assembly.
Figure 1B:
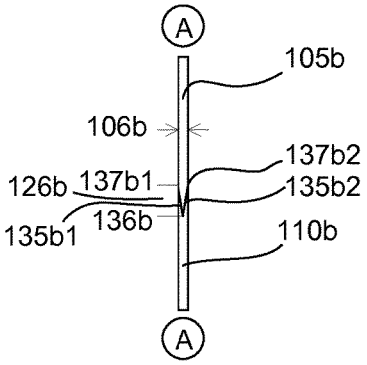

With initial reference to FIGS. 1A and 1B, a safety utility blade 100 may have a body 105 formed from a relatively thin and substantially flat material 107, such as ceramic, heat treated carbon steel, ceramic coated steel, stainless steel, Teflon coated material, etc. For example, the material 107 may be approximately 0.025 inches thick 106*b*. A blade blank (e.g. blade blank 300*a*, 400*a*, 1000*a*, 1000*b* of FIGS. 3A, 4A, 10A and 10B, respectively) may be 1.0964567 inches from a first end 132 to a second end 142 and 0.3917323 inches from a top side 108 to a bottom side 109. The safety utility blade may include blade securing holes 115, 120, 125 which may be approximately 0.0984252 inches in diameter. As described herein the blade securing holes 115, 120, 125 may, at least in part, secure a safety utility blade 100 to a safety utility knife cutting head (e.g., safety utility knife cutting head 500*a* of FIG. 5A or 500*b* of FIG. 5B). The safety utility blade 100 may be formed from a suitable material 107 for retaining a sharpened edge 136, 137, and, when that material 107 is metal, the body 105 preferably has a thickness 106*b* of at least 0.0156 inches and preferably not greater than about 0.0313 inches. What might be characterized as a "heavy-duty" safety utility blade 100 is approximately 0.025 inches thick, and the thickness 106*b* for what might be characterized as a "regular duty" safety utility blade 100 is approximately 0.017 inches. The sharpened portion 135, 145 is approximately 0.0492 inches high. A center of the first blade securing hole 115 may be approximately 0.23622 inches from the bottom side 109 and approximately 0.54825 inches from the first end 132. A center of the second blade securing hole 120 may be approximately 0.07874 inches from the bottom side 109 and approximately 0.449825 inches from the first end 132. A center of the third blade securing hole 125 may be approximately 0.07874 inches from the bottom side 109 and approximately 0.449825 inches from the second end 142. The sharpened portion 135, 145 may be coated with a material, such as paint, that may wear away as the associated safety utility blade 100 is being used to indicate whether the safety utility blade 100 has been used. The consistency of the material, such as paint, may be selected such that the amount of wear of the material is indicative of the amount of use of and/or the sharpness of the safety utility blade 100.

With further reference to FIGS. 1A and 1B, the safety utility blade 100 may include a body portion 105, 105*b* and a blade attachment portion 110, 110*b*. The first sharpened portion 135 of the safety utility blade 100 may include a first shoulder 137, a first cutting edge 136, a first heel 139 and a first toe 138. The blade attachment portion 110, 110*b* may include a first edge 111 extending from the first heel 139 to the bottom side 109. The safety utility blade 100 may further include a first blade shield 130 having a first blunt tip 131 having a radius approximately 0.03937 inches and a thickness that is greater than the first sharpened portion 135 and less than or equal to the thickness 106*b* of the body 105. The first blade shield 130 may include a first inner edge 133 that extends from the first toe 139 to the first blunt tip 131 and may have a thickness that is greater than the first sharpened portion 135 and less than or equal to the thickness 106*b* of the body 105, 105*b*. A first distance 126*b* between the first shoulder 137 and the first cutting edge 136 may be approximately 0.04921 inches.

With further reference to FIGS. 1A and 1B, the safety utility blade 100 may include a second sharpened portion 145 which may include a second shoulder 147, a second cutting edge 146, a second heel 149 and a second toe 148. The blade attachment portion 110, 110*b* may include a second edge 112 extending from the second heel 149 to the bottom side 109. The safety utility blade 100 may further include a second blade shield 140 having a second blunt tip 141 having a radius approximately 0.03937 inches and a thickness that is greater than the second sharpened portion 145 and less than or equal to the thickness 106*b* of the body 105. The second blade shield 140 may include a second inner edge 143 that extends from the second toe 149 to the second blunt tip 141 and may have a thickness that is greater than the second sharpened portion 145 and less than or equal to the thickness 106*b* of the body 105. A second distance 150 between the bottom side 109 and the second blunt tip 141 may be approximately 0.05315 inches. A third distance 155 between the bottom side 109 and the second heel 149 may be approximately 0.0687 inches. A fourth distance 160 between the bottom side 109 and the second toe 148 may be approximately 0.0774 inches. A fifth distance 161 between the bottom side 109 and the second cutting edge 146 may be approximately 0.1496 inches. As depicted in FIG. 1*b*, the cutting edge 136*b* may be defined by a third sharpened portion 135*b*1 extending from a third shoulder 137*b*1 and a fourth sharpened portion 135*b*2 extending from a fourth shoulder 137*b*2. It should be understood that either of the cutting edges 136, 146 may be formed similar to cutting edge 136*b*. The sharpened portion 135, 145, the third sharpened portion 135*b*1 and/or the fourth sharpened portion 135*b*2 may be substantially concave or convex shaped. Alternatively, a portion of the sharpened portion 135, 145, a portion of the third sharpened portion 135*b*1 and/or a portion of the fourth sharpened portion 135*b*2 may be substantially concave or convex shaped with the remainder defining a linear shape.

Figure 2:
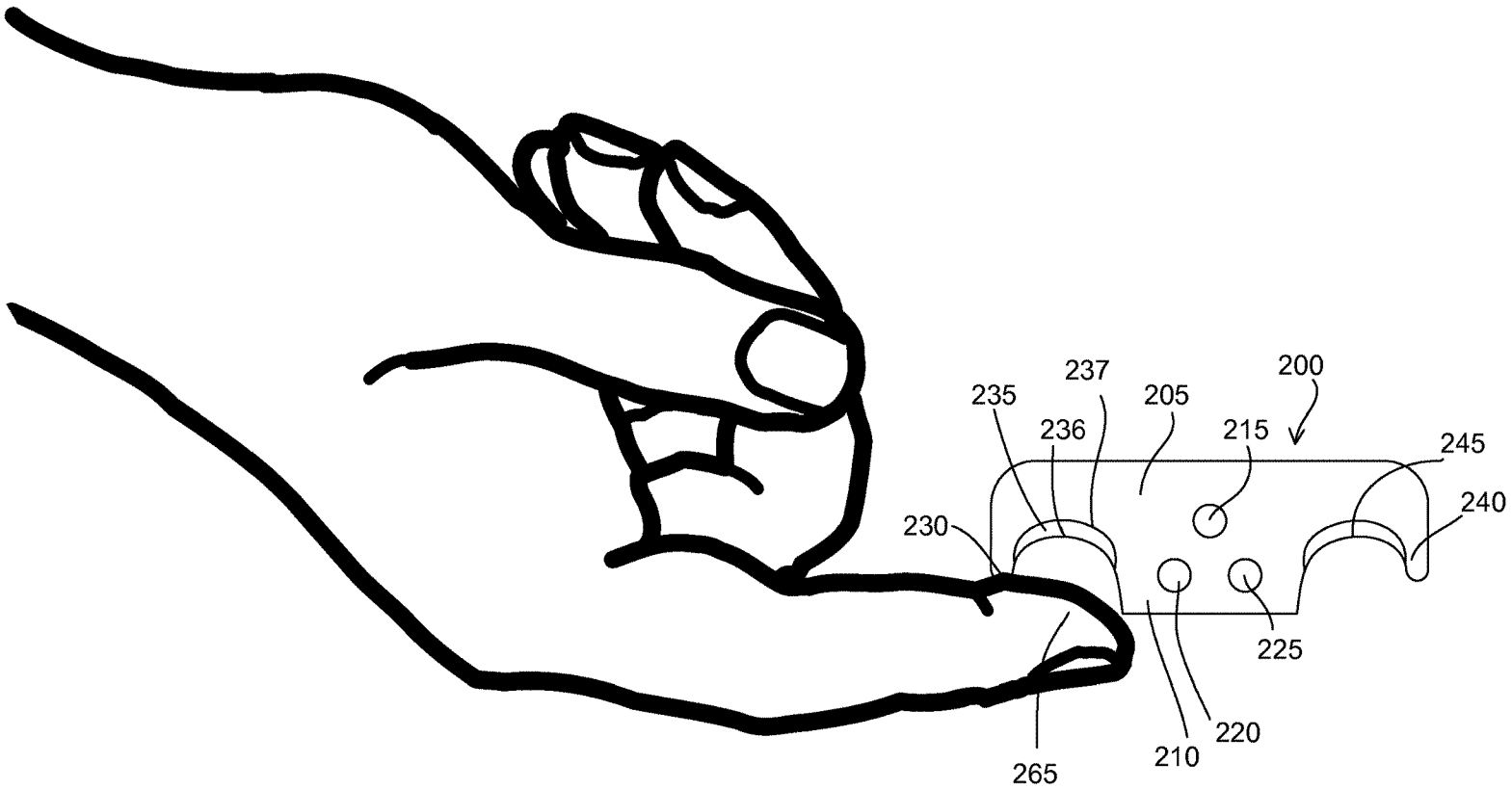
FIG. 2 depicts the safety utility blade of FIGS. 1*a* and 1*b* in proximity to a human finger.

Turning to FIG. 2, a safety utility blade 200 is depicted proximate a human finger 265. The safety utility blade 200 may be similar to the safety utility blade 100 of FIGS. 1A and 1B having a first sharpened portion 235 defining a first shoulder 237 and a first cutting edge 236. As can be seen in FIG. 2, a first blade shield 230 may cooperate with the blade attachment portion 210 to limit access of the human finger 265 to the first cutting edge 236. Similarly, the second blade shield 240 may cooperate with the blade attachment portion 210 to limit access to the second sharpened portion 245. In either event, the safety utility blade 200 may be configured to limit access to associated cutting edges while the safety utility blade is being removed from an associated package, being inserted in a corresponding safety utility knife assembly (e.g., safety utility knife assembly 700 of FIG. 7), when being removed from a corresponding safety utility knife assembly and while being used within a corresponding safety utility knife assembly. The safety utility blade 200 may have a body portion 205 constructed similar to the body portion 105. The safety utility blade 200 may include blade securing holes 215, 220, 225 for securing the safety utility blade 200 to a corresponding safety cutting head (e.g., either safety cutting head 500*a* or 500*b* of FIGS. 5A and 5B, respectively) or securing the safety utility blade to a handle (e.g., a handle 685 of FIG. 6).

Figure 3A:
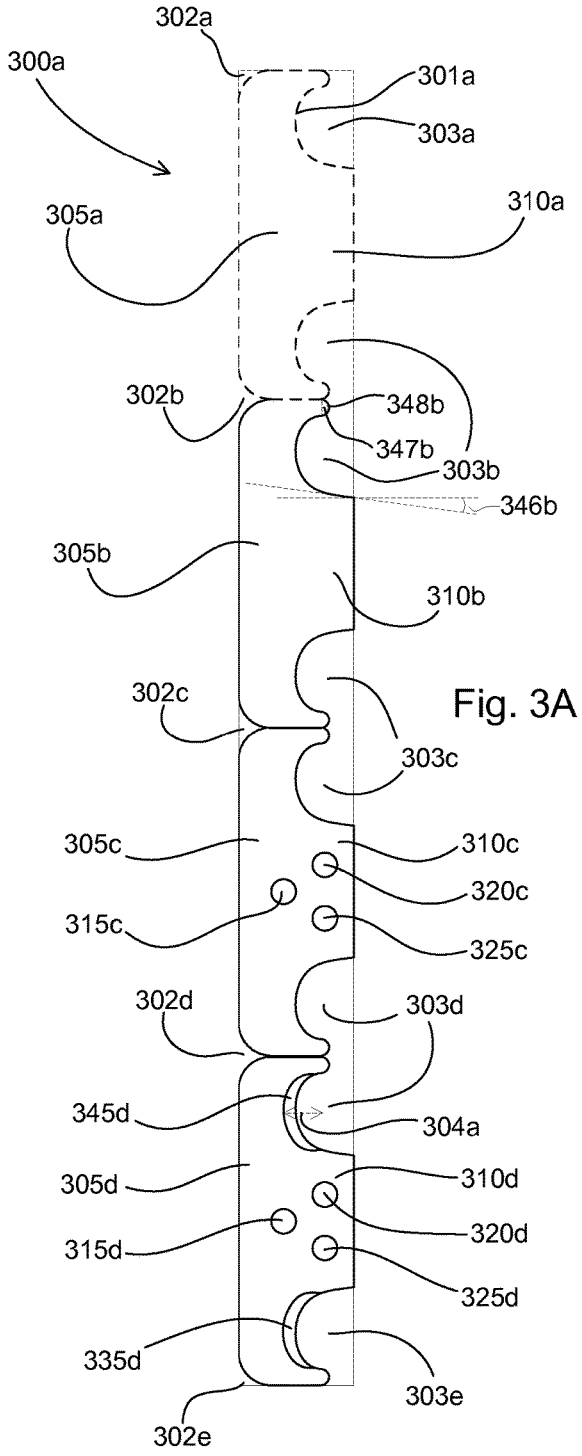
FIG. 3A depicts an example progression of manufacturing the safety utility blade of FIGS. 1*a*, 1*b* and 2.

With reference now to FIGS. 3A-3D, a method 300*d* of manufacturing a safety utility blade (e.g., safety utility blade 100 of FIG. 1) is described. A strip of blade material 300*a* is provided (block 370*d*). The individual rough blade shapes 301*a* may remain attached to one another while each of the individual steps 375*d*-385*d* are performed. A rough blade shape 301*a* is formed in the strip of blade material 300*a* (block 375*d*) by removing material 302*a*, 303*a*, 302*b*, 303*b*. The material 302*a*, 303*a*, 302*b*, 303*b* may be removed from the strip of blade material 300*a* by laser cutting, machining, water jet cutting, stamp shearing or any other suitable technique. The material 302*c*, 303*c*, 302*d*, 303*d*, 302*e*, 303*e* may be removed prior to steps 380*d*, 385*d* being performed or the steps 380*d*, 385*d* may be performed on each rough blade shape 301*a* prior to removing the material 302*c*, 303*c*, 302*d*, 303*d*, 302*e*, 303*e* associated with the next rough blade shape 301*a*. An edge (e.g., edge 111 and/or 112 of FIG. 1) of the blade attachment portion 310*b* may form an angle 346*b* with respect to a blade bottom edge (e.g., bottom 109 of FIG. 1) of approximately 21.2° to encourage material to be cut to move toward the blade end 347*b*. The angle 346*b* may be between approximately 15° and approximately 25°. As can be seen in FIG. 3A, each rough blade shape 301*a* may include a blade body portion 305*a*, 305*b*, 305*c*, 305*d* and a blade attachment portion 310*a*, 310*b*, 310*c*, 310*d*. Blade securing holes 315*c*, 320*c*, 325*c*, 315*d*, 320*d*, 325*d* may be formed in each rough blade shape 301*a* (block 380*d*). The blade securing holes 315*c*, 320*c*, 325*c*, 315*d*, 320*d*, 325*d* may be formed by any suitable method, such as laser cutting, water jet cutting, machining, drilling, stamp shearing, etc.

Figure 3B:
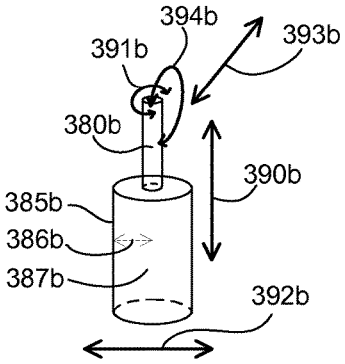
FIG. 3B depicts an example blade edge grinding and honing drum apparatus.

With further reference to FIGS. 3A-3D, a first blade cutting edge 335*d* and a second blade cutting edge 345*d* may be formed in each rough blade shape 301*a* (block 385*d*). The first blade cutting edge 335*d* may be formed prior to the second blade cutting edge 345*d* or the first blade cutting edge 335*d* and the second blade cutting edge 345*d* may be formed simultaneously. The first blade cutting edge 335*d* and the second blade cutting edge 345*d* may be formed using a blade edge grinding and honing drum 385*b*, a blade edge grinding and honing wheel 385*c* or any other suitable method. The blade edge grinding and honing drum 385*b* may have a radius 386*b* that is substantially the same as the desired cutting edge radius 304*a*. The blade edge grinding and honing drum 385*b* may include a grinding surface 387*b* of any desired roughness and hardness to form the sharpened surface portion (e.g., sharpened surface portion 335*d*, 345*d*). As depicted in FIG. 3B, the blade edge grinding and honing drum 385*b* may include a spindle 380*b* for attaching the blade edge grinding and honing drum 385*b* to an associated driving and actuating machine (not shown) to rotate the blade edge grinding and honing drum 385*b* or move the blade edge grinding and honing drum 385*b* in any combination of a x-direction 392*b*, a y-direction 390*b* and a z-direction 393*b* relative to the strip of blade material 300*a* to produce a sharpened portion 135, 145, 135*b*1, 135*b*2. Alternatively, the strip of blade material 300*a* may be oriented and moved in any one of or a combination of a x-direction 392*b*, a y-direction 390*b* and a z-direction 393*b* relative to the blade edge grinding and honing drum 385*b* to produce a sharpened portion 135, 145, 135*b*1, 135*b*2. The blade edge grinding and honing drum 385*b* may be rotated about a central axis 391*b* to produce a grinding and honing motion of the grinding surface 387*b* relative first blade cutting edge 335*d* and the second blade cutting edge 345*d*. The blade edge grinding and honing drum 385*b* rotated into position around a pivot axis 394*b* when a corresponding rough blade shape 305*c* is moved into an appropriate position relative the blade edge grinding and honing drum 385*b*.

Figure 3C:
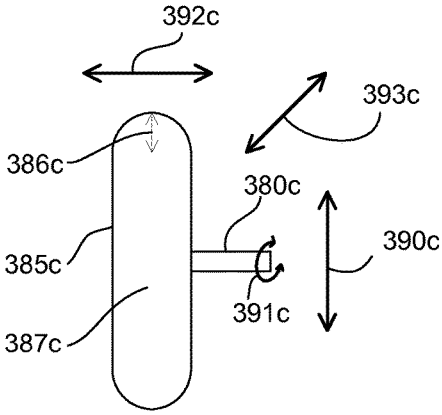
FIG. 3C depicts an example blade edge grinding and honing wheel.
Figure 3D:
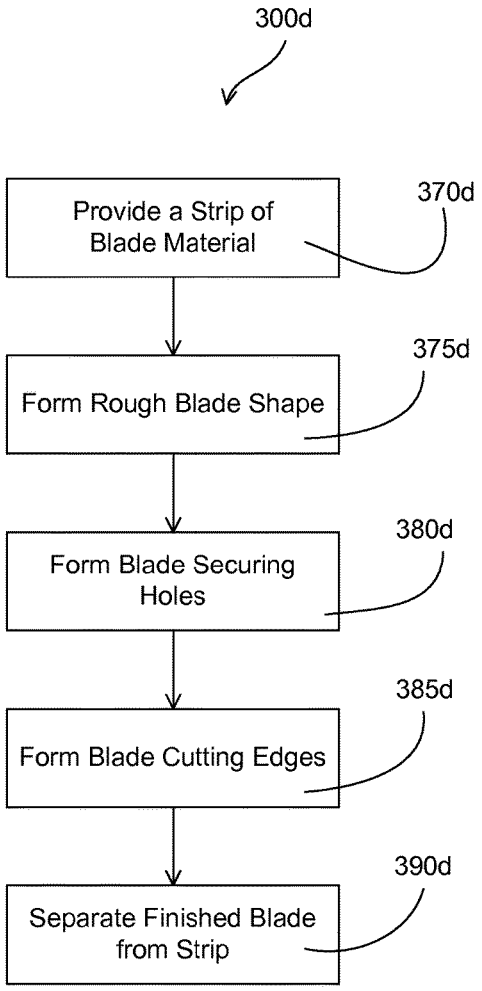
FIG. 3D depicts an example flow diagram for a method of manufacturing the safety utility blade of FIG. 3A.
Figure 3E:
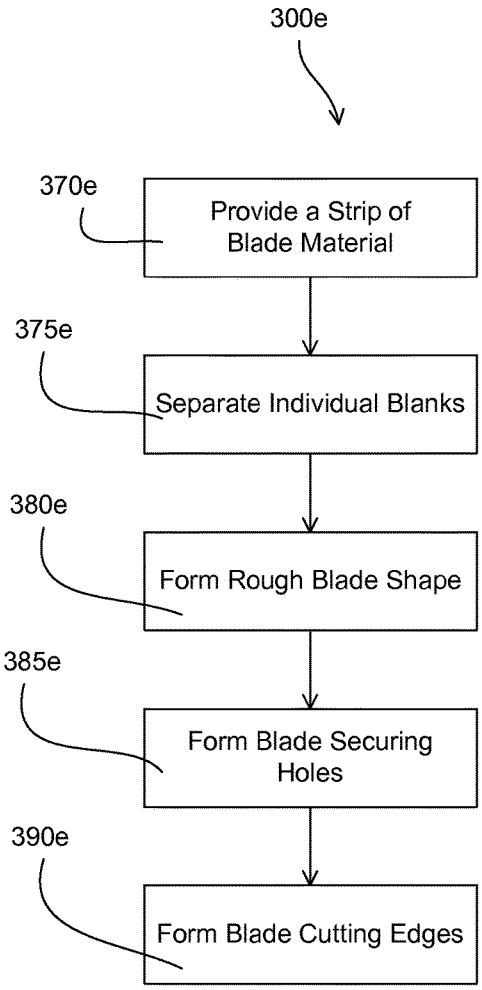
FIG. 3E depicts an example flow diagram for a method of manufacturing the safety utility blade of FIGS. 4A-4D.
Figure 4A:
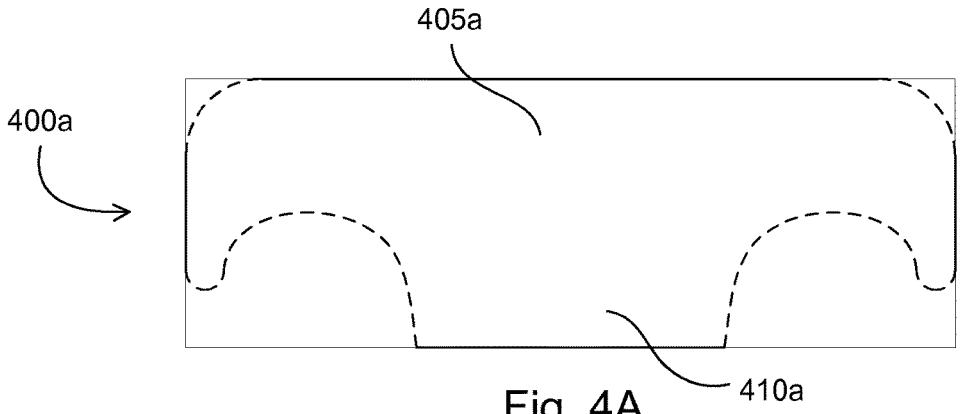
FIGS. 4A-4D depict a second example progression of manufacturing the safety utility blade of FIGS. 1A, 1B and 2.
Figure 4B:
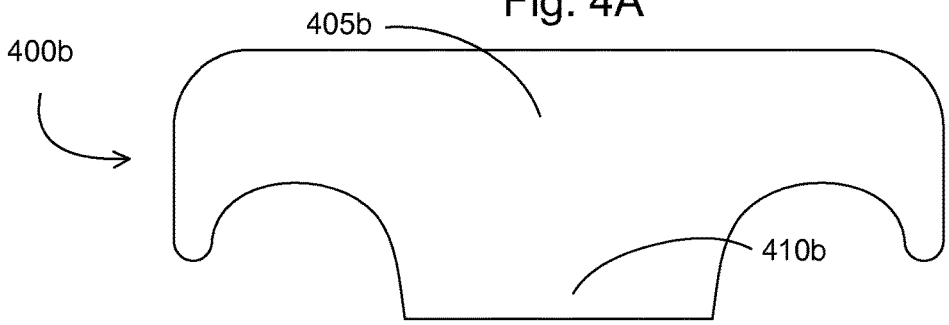
Figure 4C:
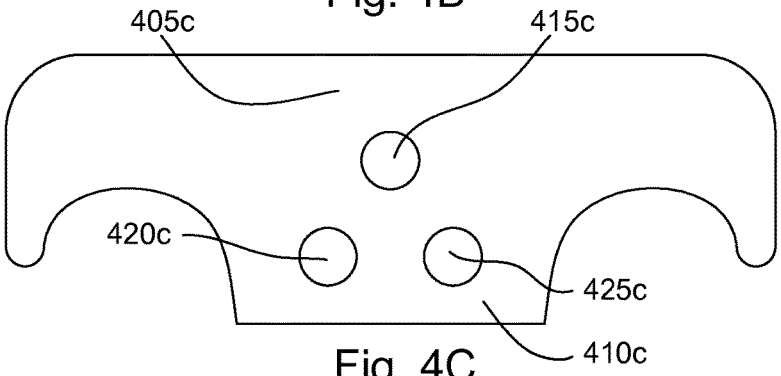
Figure 4D:
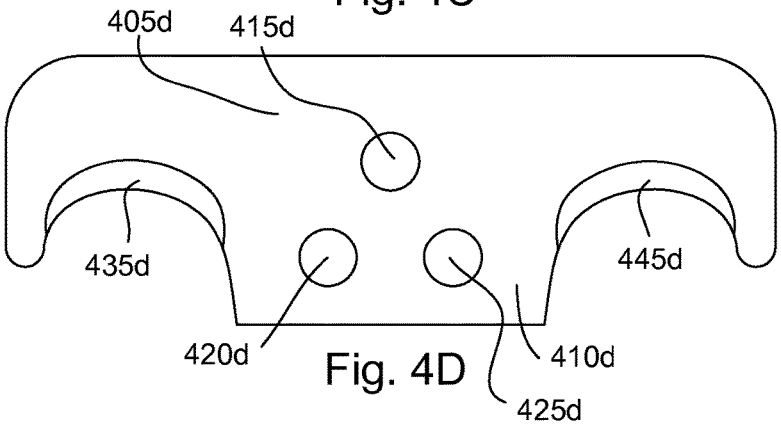

Alternatively, the first blade cutting edge 335*d* and the second blade cutting edge 345*d* may be formed using a blade edge grinding and honing wheel 385*c* or any other suitable method. The blade edge grinding and honing wheel 385*c* may have a radius 386*c* that is substantially the same as the desired cutting edge radius 304*a*. The blade edge grinding and honing wheel 385*c* may include a grinding surface 387*c* of any desired roughness and hardness to form the sharpened surface portion (e.g., sharpened surface portion 335*d*, 345*d*). As depicted in FIG. 3C, the blade edge grinding and honing wheel 385*c* may include a spindle 380*c* for attaching the blade edge grinding and honing wheel 385*c* to an associated driving and actuating machine (not shown) to rotate the blade edge grinding and honing wheel 385*c* and/or move the blade edge grinding and honing wheel 385*c* in any combination of a x-direction 392*c*, a y-direction 390*c* and a z-direction 393*c* relative to the strip of blade material 300*a* to produce a sharpened portion 135, 145, 135*b*1, 135*b*2. Alternatively, the strip of blade material 300*a* may be oriented and moved in any one of or a combination of a x-direction 392*c*, a y-direction 390*c* and a z-direction 393*c* relative to the blade edge grinding and honing wheel 385*c* to produce a sharpened portion 135, 145, 135*b*1, 135*b*2. The blade edge grinding and honing wheel 385*c* may be rotated about a central axis 391*c* to produce a grinding and honing motion of the grinding surface 387*c* relative first blade cutting edge 335*d* and the second blade cutting edge 345*d*. The blade edge grinding and honing wheel 385*c* rotated into position around a pivot axis 394*c* when a corresponding rough blade shape 305*c* is moved into an appropriate position relative the blade edge grinding and honing wheel 385*c*.

Once the blade securing holes 315*c*, 320*c*, 325*c* and the sharpened surface portions 335*d*, 345*d* are formed in a respective rough blade shape 301*a*, the finished safety utility blade 100 may be separated from the strip of blade material 300*a* (block 390*d*). Alternatively, with reference to FIGS. 3E and 4A-4D, a strip of blade material 300*a* may be provided (block 370*e*) and individual blade blanks 400*a* may be separated from the strip of blade material 300*a* (block 375*e*). Rough blade shapes 400*b* may be formed from the individual blade blanks 400*a* by laser cutting, machining, water jet cutting, stamp shearing or any other suitable technique (block 380*e*). The rough blade shapes may include a blade body portion 405*a*, 405*b*, 405*c*, 405*d* and a blade attachment portion 410*a*, 410*b*, 410*c*, 410*d*. Blade securing holes 415*c*, 420*c*, 425*c*, 415*d*, 420*d*, 425*d* may be formed in the rough blade shapes by any suitable method, such as laser cutting, water jet cutting, machining, drilling, stamp shearing, etc. (block 385*e*).

With further reference to FIGS. 3E and 4A-4D, a first blade cutting edge 435*d* and a second blade cutting edge 445*d* may be formed in each rough blade shape 400*a* (block 390*d*). The first blade cutting edge 435*d* may be formed prior to the second blade cutting edge 445*d* or the first blade cutting edge 435*d* and the second blade cutting edge 445*d* may be formed simultaneously. The first blade cutting edge 435*d* and the second blade cutting edge 445*d* may be formed using a blade edge grinding and honing drum 385*b*, a blade edge grinding and honing wheel 385*c* or any other suitable method. The blade edge grinding and honing drum 385*b* may have a radius 386*b* that is substantially the same as the desired cutting edge radius 304*a*. The blade edge grinding and honing drum 385*b* may include a grinding surface 387*b* of any desired roughness and hardness to form the sharpened surface portion (e.g., sharpened surface portion 435*d*, 445*d*). As depicted in FIG. 3B, the blade edge grinding and honing drum 385*b* may include a spindle 380*b* for attaching the blade edge grinding and honing drum 385*b* to an associated driving and actuating machine (not shown) to rotate the blade edge grinding and honing drum 385*b* or move the blade edge grinding and honing drum 385*b* in any combination of a x-direction 392*b*, a y-direction 390*b* and a z-direction 393*b* relative to the rough blade shape 400*b*. Alternatively, the rough blade shape 400*b* may be oriented and moved in any one of or a combination of a x-direction 392*b*, a y-direction 390*b* and a z-direction 393*b* relative to the blade edge grinding and honing drum 385*b*.

Alternatively, the first blade cutting edge 435*d* and the second blade cutting edge 445*d* may be formed using a blade edge grinding and honing wheel 385*c* or any other suitable method. The blade edge grinding and honing wheel 385*c* may have a radius 386*c* that is substantially the same as the desired cutting edge radius 304*a*. The blade edge grinding and honing wheel 385*c* may include a grinding surface 387*c* of any desired roughness and hardness to form the sharpened surface portion (e.g., sharpened surface portion 435*d*, 445*d*). As depicted in FIG. 3C, the blade edge grinding and honing wheel 385*c* may include a spindle 380*c* for attaching the blade edge grinding and honing wheel 385*c* to an associated driving and actuating machine (not shown) to rotate the blade edge grinding and honing wheel 385*c* and/or move the blade edge grinding and honing wheel 385*c* in any combination of a x-direction 392*c*, a y-direction 390*c* and a z-direction 393*c* relative to the rough blade shape 400*b*. Alternatively, the rough blade shape 400*b* may be oriented and moved in any one of or a combination of a x-direction 392*c*, a y-direction 390*c* and a z-direction 393*c* relative to the blade edge grinding and honing wheel 385*c*.

Whether the safety utility blade 100 is completed prior to separating the rough blade shapes 301*a* from the strip of blade material 300*a* or the safety utility blade 100 is completed after the individual blade blanks 400*a* are separated from a strip of blade material 300*a*, a series of grinding and honing drums 385*b* and/or grinding and honing wheels 385*c* may be used to form the sharpened surface portion 335*d*, 345*d*, 435*d*, 445*d*. Each grinding and honing drum 385*b* and/or grinding and honing wheel 385*c* in a series of grinding and honing drums 385*b* and/or grinding and honing wheels 385*c* may have a progressively finer and finer grinding and honing surface 387*b*, 387*c* relative to the preceding grinding and honing drum 385*b* and/or grinding and honing wheel 385*c* in the series.

Figure 5A:
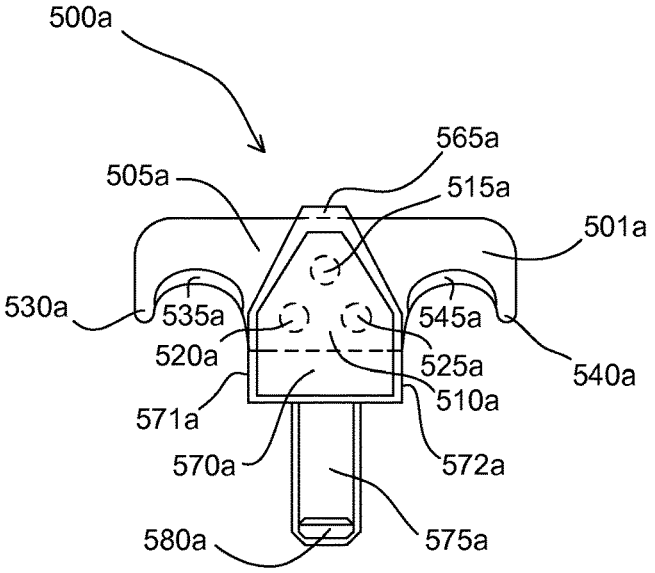
FIGS. 5A and 5B depict examples of safety cutter heads which include a safety utility blade of FIGS. 1*a*, 1*b*, 2, 3A and 4A-4D.

Turning to FIG. 5A, a safety cutting head 500*a* is depicted including a safety utility blade 501*a* attached to a handle adaptor 570*a*. The safety utility blade 501*a* may include a blade body portion 505*a*, an blade attachment portion 510*a*, blade securing holes 515*a*, 520*a*, 525*a*, a first sharpened portion 535*a*, a first blade shield 530*a*, a second sharpened portion 545*a* and a second blade shield 540*a*. The handle adaptor 570*a* may include a body portion 565*a* having a first side 571*a* and a second side 572*a*. As depicted in FIG. 5A, the width of the body portion 565*a* may be substantially equal the width of the blade attachment portion 510*a*. As also depicted in FIG. 5A, the body portion 565*a* may extend beyond the blade body portion 505*a*. The extension of the body portion 565*a* may cooperate with the securing holes 515*a*, 520*a*, 525*a* to secure the safety utility blade 501*a* to the handle adaptor 570*a*. For example, the handle adaptor may be made of a thermal plastic material and may be co-molded around the safety utility blade 501*a* such that the thermal plastic material penetrates through the blade securing holes 515*a*, 520*a*, 525*a* and form a mirror half of the body portion 565*a* on either side of the safety utility blade 501*a* to encapsulate the blade body portion 505*a* of the safety utility blade 501*a*. The handle adaptor 570*a* may include a handle engagement portion 575*a* with a handle securing mechanism 580*a* to secure the safety cutting head 500*a* to a corresponding handle (e.g., handle 685 of FIG. 6).

Figure 5B:
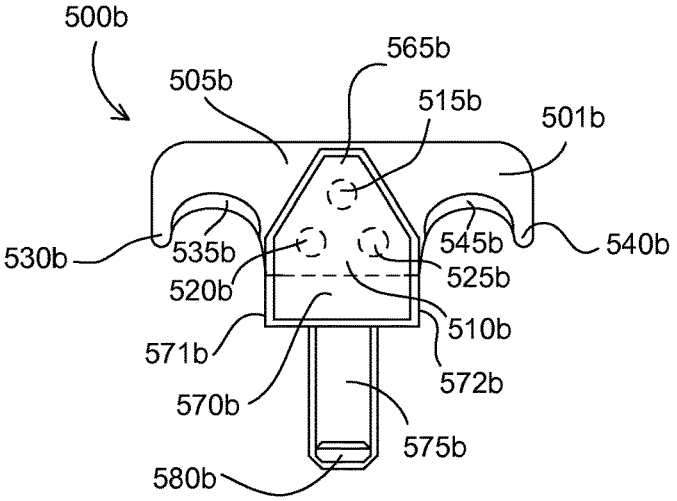

Turning to FIG. 5B, a safety cutting head 500*b* is depicted including a safety utility blade 501*b* attached to a handle adaptor 570*b*. The safety utility blade 501*b* may include a blade body portion 505*b*, an blade attachment portion 510*b*, blade securing holes 515*b*, 520*b*, 525*b*, a first sharpened portion 535*b*, a first blade shield 530*b*, a second sharpened portion 545*b* and a second blade shield 540*b*. The handle adaptor 570*b* may include a body portion 565*a* having a first side 571*b* and a second side 572*b*. As depicted in FIG. 5A, the width of the body portion 565*b* may be substantially equal the width of the blade attachment portion 510*b*. The body portion 565*b* may cooperate with the securing holes 515*b*, 520*b*, 525*b* to secure the safety utility blade 501*b* to the handle adaptor 570*b*. For example, the handle adaptor may be made of a thermal plastic material and may be co-molded around the safety utility blade 501*b* such that the thermal plastic material penetrates through the blade securing holes 515*b*, 520*b*, 525*b* and form a mirror half of the body portion 565*b* on either side of the safety utility blade 501*b* to encapsulate the blade body portion 505*b* of the safety utility blade 501*b*. The handle adaptor 570*b* may include a handle engagement portion 575*b* with a handle securing mechanism 580*b* to secure the safety cutting head 500*b* to a corresponding handle (e.g., handle 685 of FIG. 6). A first side 571*b* and a second side 572*b* of a handle adaptor 570*b* may cooperate with a body portion 565*b* to form a "clamshell" and fasteners, such as metal pins, may be included to cooperate with the securing holes 515*b*, 520*b*, 525*b* to replaceably secure a safety utility blade 100 within a safety cutting head 500*b*. When a clamshell structure is provided, a handle engagement portion 575*b* may be configured with two halves with each halve being fixed to a respective side 571*b*, 572*b* of the handle adaptor 570*b*. When a safety utility blade 100 is placed within a clamshell structure and the clamshell structure is engaged with a handle 685, the safety utility blade 100 is secured within the clamshell structure of the safety cutting head 500*b*. The body portion 565*b* may be configured as a hinge mechanism within a clamshell structure and fasteners, such as metal pins, may be fixed to a respective side 571*b*, 572*b* of the handle adaptor 570*b*.

Figure 6:
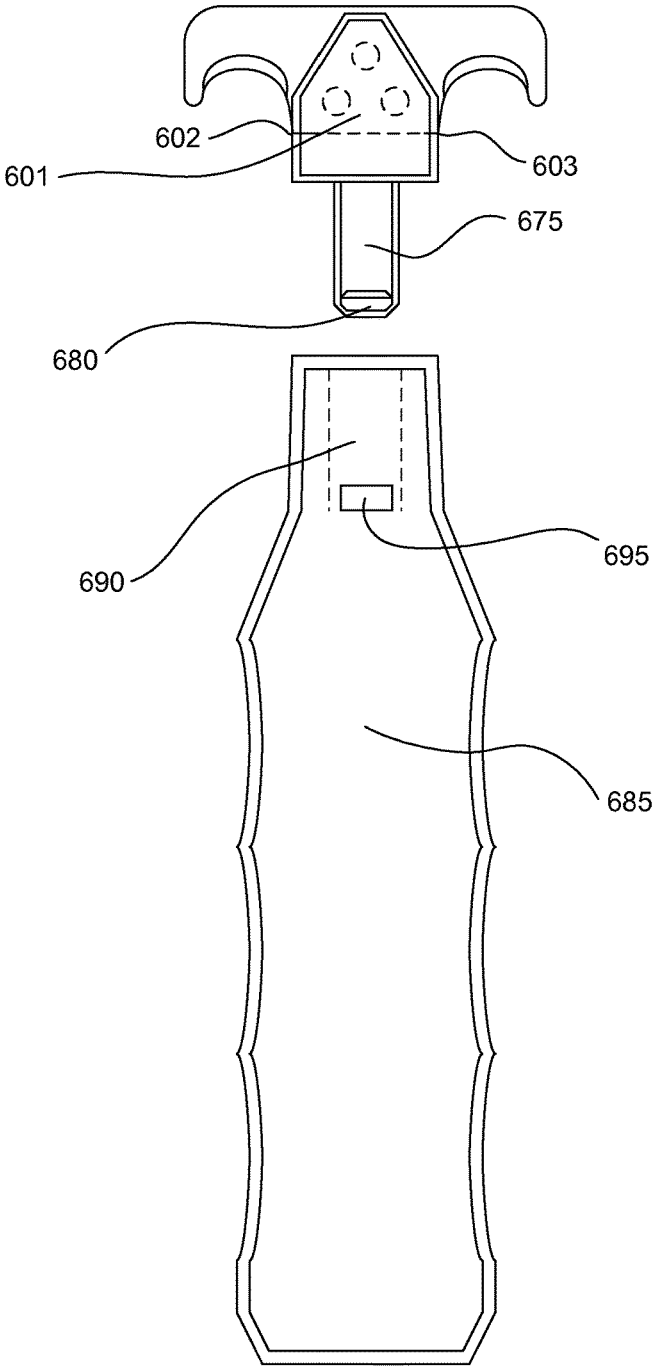
FIG. 6 depicts the safety cutter head of FIG. 5B proximate an associated safety utility knife handle.

Turning to FIG. 6, a safety cutting head 601 is depicted proximate an associated handle 685. The safety cutting head 601 may include a first body side 602 and a second body side 603. The safety cutting head 601 may include a handle engagement 675 having a handle securing mechanism 680.

The handle 685 may include a cutting head engagement 690 having a cutting head securing mechanism 695.

Figure 7:
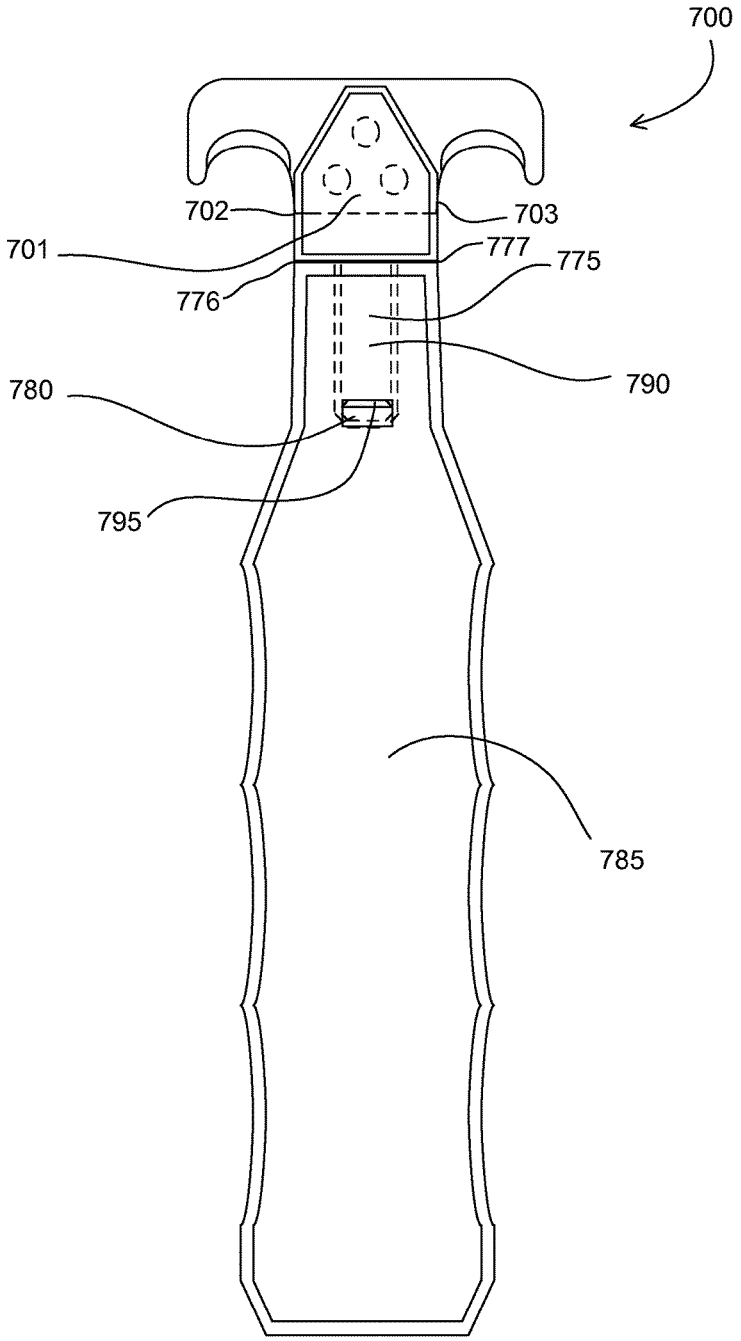
FIG. 7 depicts the safety cutter head of FIG. 5B engaged with an associated safety utility knife handle to form a safety utility knife assembly.

With reference now to FIG. 7, a safety utility knife assembly 700 is depicted including a safety cutting head 701 and a handle 785. The safety cutting head 701 may include a first side 702 that aligns with a first handle side 776 and a second side 703 that aligns with a second handle side 777 when the handle engagement 775 is secured to the cutting head engagement 790 via the handle securing mechanism 780 and the cutting head securing mechanism 795. A safety utility knife assembly 700 may be configured to store one or more additional safety cutting heads 701. For example, a second safety cutting head 701 may be secured to each end of the handle 785. Alternatively, the handle 785 may include a spare safety cutting head 701 retaining mechanism.

Turning now to FIGS. 8A-8H and 8J-8K, a safety utility knife assembly 800*a*, 800*b*, 800*c*, 800*d*, 800*e*, 800*f*, 800*g*, 800*h*, 800*j*, 800*k* is depicted including a blade 810*a*, 810*b*, 810*c*, 810*e*, 810*f*, 810*g*, 810*k* within a blade holder 805*a*, 805*b*, 805*c*, 805*d*, 805*e*, 805*f*, 805*g*, 805*j*, 805*j*, 805*k* inserted in a handle 815*a*, 815*b*, 815*c*, 815*d*, 815*e*, 815*f*, 815*g*, 815*h*, 815*j*, 815*k*. The blade holder 805*a*, 805*b*, 805*c*, 805*d*, 805*e*, 805*f*, 805*g*, 805*j*, 805*j*, 805*k* may include a handle engagement 806*b*, 806*d*, 806*e*, 806*f*, 806*g*, 806*j* a blade retaining offset 808*e* and blade retainer 807*d*, 807*e*. The handle 815*a*, 815*b*, 815*c*, 815*d*, 815*e* may include a blade holder engagement 816*b*, 816*e*, 816*f* that cooperates with the handle engagement 806*b*, 806*d*, 806*e*, 806*g*, 806*j* to secure the blade holder 805*a*, 805*b*, 805*c*, 805*d*, 805*e*, 805*f*, 805*g*, 805*j*, 805*j*, 805*k* within the handle 815*a*, 815*b*, 815*c*, 815*d*, 815*e*, 815*f*, 815*g*, 815*h*, 815*j*, 815*k*. The blade retaining offset 808*e*, a first blade retainer 807*d*, 807*e*, 807*f*, a second blade retainer 808*f* and a third blade retainer 809*f* cooperate with the handle 815*a*, 815*b*, 815*c*, 815*d*, 815*e* to secure the blade edge 812*c*, 812*f* proximate a blade retaining offset surface 811*c*, 811*f*. The safety utility knife assembly 800*a*, 800*b*, 800*c*, 800*d*, 800*e*, 800*f*, 800*g*, 800*h*, 800*j*, 800*k* may include a spare blade compartment to store unused blades 810*a*, 810*b*, 810*c*, 810*e*, 810*f*, 810*g*, 810*k*.

Figure 9A:
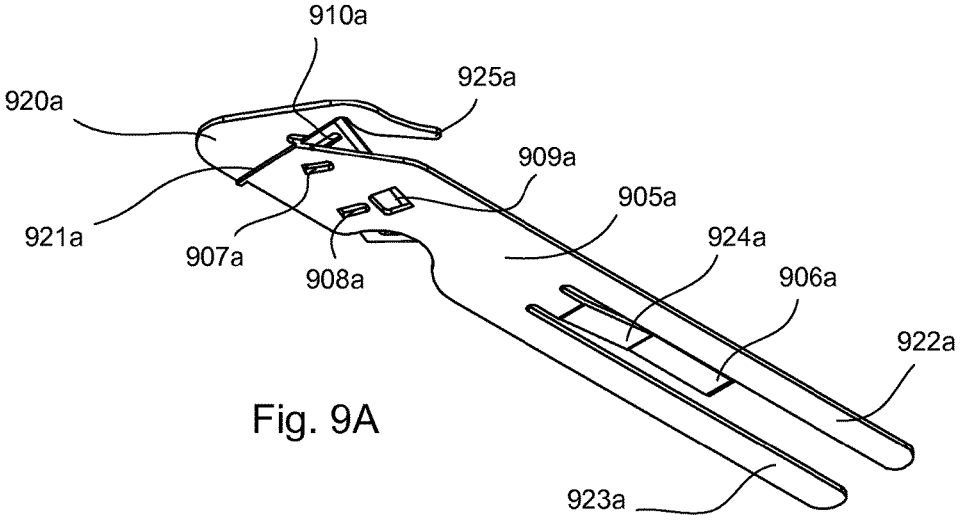
FIGS. 9A-9H and 9J depict an example blade carriage for use within the safety utility knife assembly of FIGS. 9A-9H and 9J.
Figure 9B:
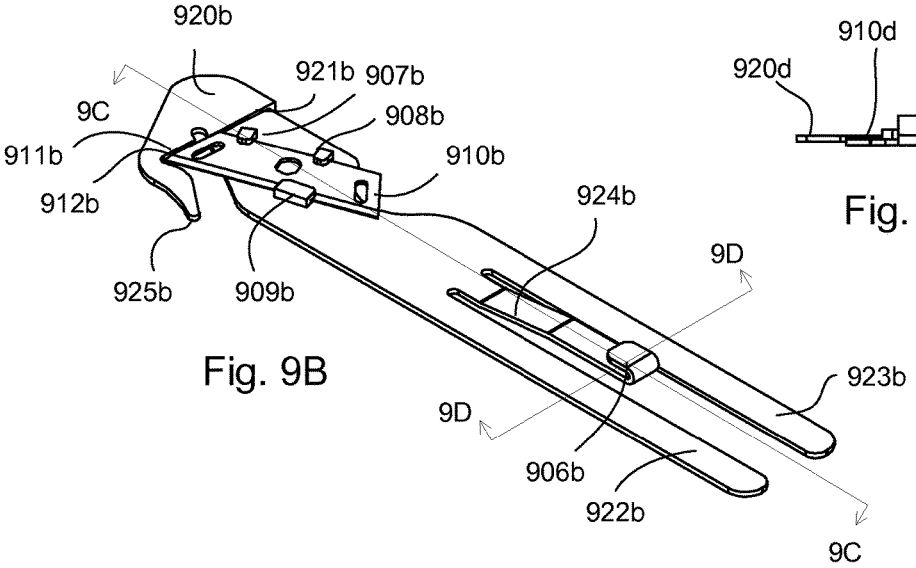
Figure 9D:
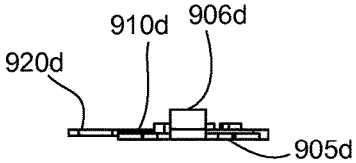
Figure 9C:
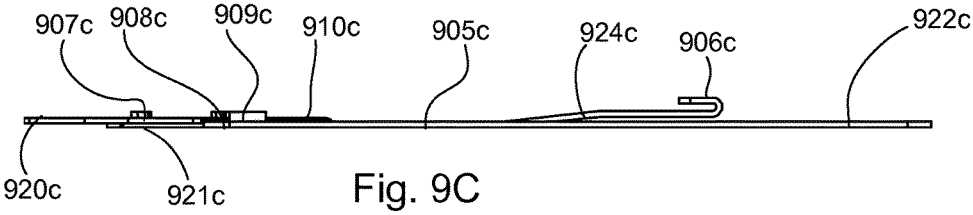
Figure 9E:
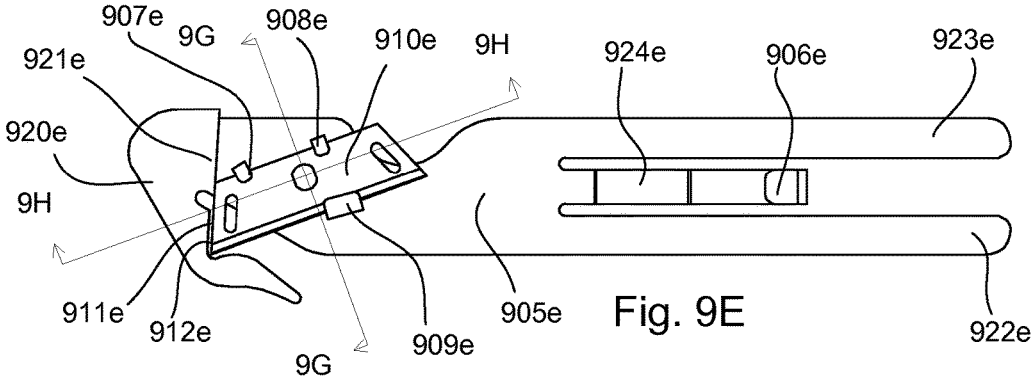
Figure 9F:
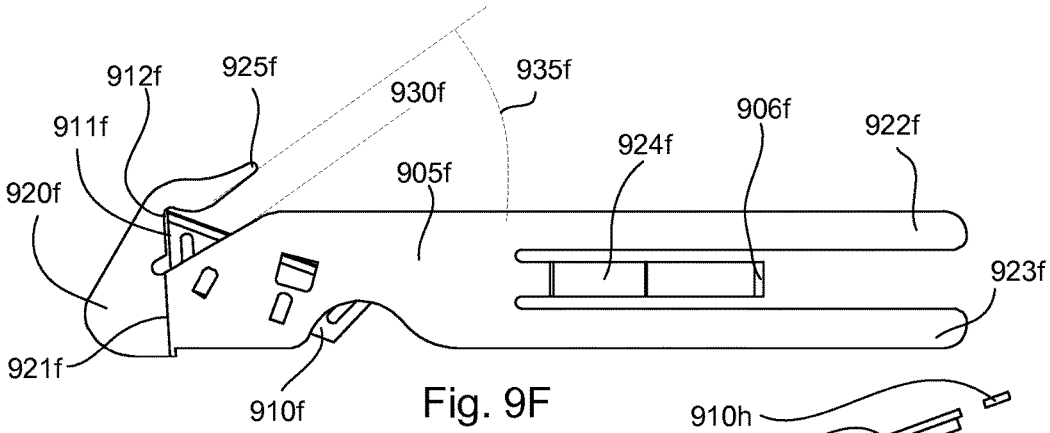
Figure 9G:
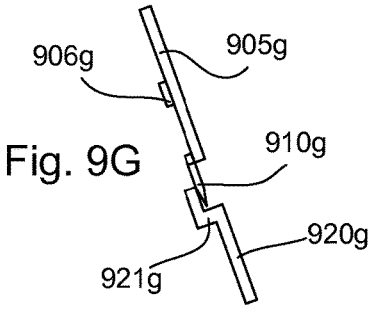
Figure 9H:
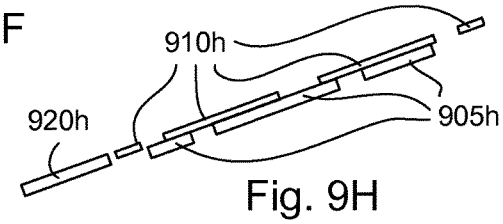
Figure 9J:
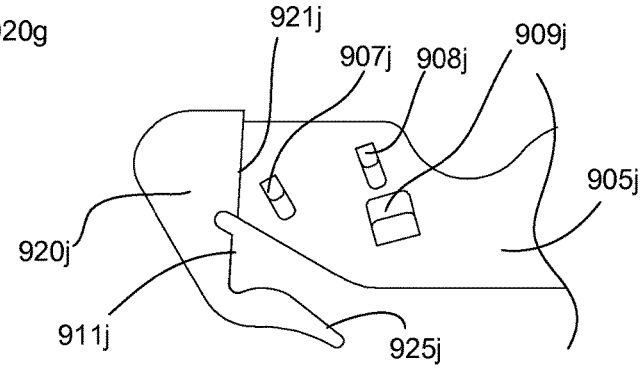

With reference to FIGS. 9A-9H and 9J a blade holder 905*a*, 905*b*, 905*c*, 905*d*, 905*e*, 905*f*, 905*g*, 905*h*, 905*j* is depicted including a blade edge 912*b*, 912*e*, 912*f* of blade 910*a*, 910*b*, 910*c*, 910*d*, 910*e*, 910*f*, 910*g*, 910*h*, 910*j* secured against a blade retaining offset surface 911*b*, 911*e*, 911*f* of the blade holder 905*a*, 905*b*, 905*c*, 905*d*, 905*e*, 905*f*, 905*g*, 905*h*, 905*j* by a first blade retainer 907*a*, 907*b*, 907*c*, 907*e*, 907*j*, a second blade retainer 908*a*, 908*b*, 908*c*, 908*e*, 908*j* and a third blade retainer 909*a*, 909*b*, 909*c*, 909*e*, 909*j*. A blade holder head 920*a*, 920*b*, 920*c*, 920*d*, 920*e*, *d*20*f*, 920*g*, 920*h*, 920*j* and blade shield 925*a*, 925*b*, 925*f*, 925*j* are offset from the blade holder 905*a*, 905*b*, 905*c*, 905*d*, 905*e*, 905*f*, 905*g*, 905*h*, 905*j* at offset surface 921*a*, 921*b*, 921*c*, 921*e*, 921*f*, 921*g*, 921*j* by a distance substantially equal to a thickness (e.g., thickness 106*b* of FIG. 1B) of the blade 910*a*, 910*b*, 910*c*, 910*d*, 910*e*, 910*f*, 910*g*, 910*h*, 910*j*. The blade holder 905*a*, 905*b*, 905*c*, 905*d*, 905*e*, 905*f*, 905*g*, 905*h*, 905*j* may include a first slide 922*a*, 922*b*, 922*c*, 922*e*, 922*f* and a second slide 923*a*, 923*b*, 923*e*, 923*f* that are received within a corresponding handle 815*a*, 815*b*, 815*c*, 815*d*, 815*e*, 815*f*, 815*g*, 815*h*, 815*j*, 815*k* and secured within the handle 815*a*, 815*b*, 815*c*, 815*d*, 815*e*, 815*f*, 815*g*, 815*h*, 815*j*, 815*k* with handle engagement mechanism 906*a*, 906*b*, 906*c*, 906*d*, 906*e*, 906*f* with biasing member 924*a*, 924*b*, 924*c*, 924*e*, 924*f*. As depicted in FIG. 9F, a blade throat 930*f* defines an angle 935*f* with respect to a longitudinal axis of the blade holder 905*f* of approximately 38°. The angle 935*f* may be between approximately 30° and approximately 45°. The blade throat 930*f* may define an angle 935*f* with respect to a longitudinal axis of the blade holder 905*f* between 25° and 50°. The blade throat 930*f* may be approximately 0.188 inches, thereby, the blade throat 930*f* limits exposure to the cutting edge of the blade 910*f*. The cutting edge of the blade 910*f* may define an angle (e.g., angle 813*c* of FIG. 8C) with respect to a longitudinal axis of the blade holder 905*f* of approximately 20°. The cutting edge of the blade 910*f* may define an angle 813*c* with respect to a longitudinal axis of the blade holder 905*f* between 15° and 25°.

Figure 10A:
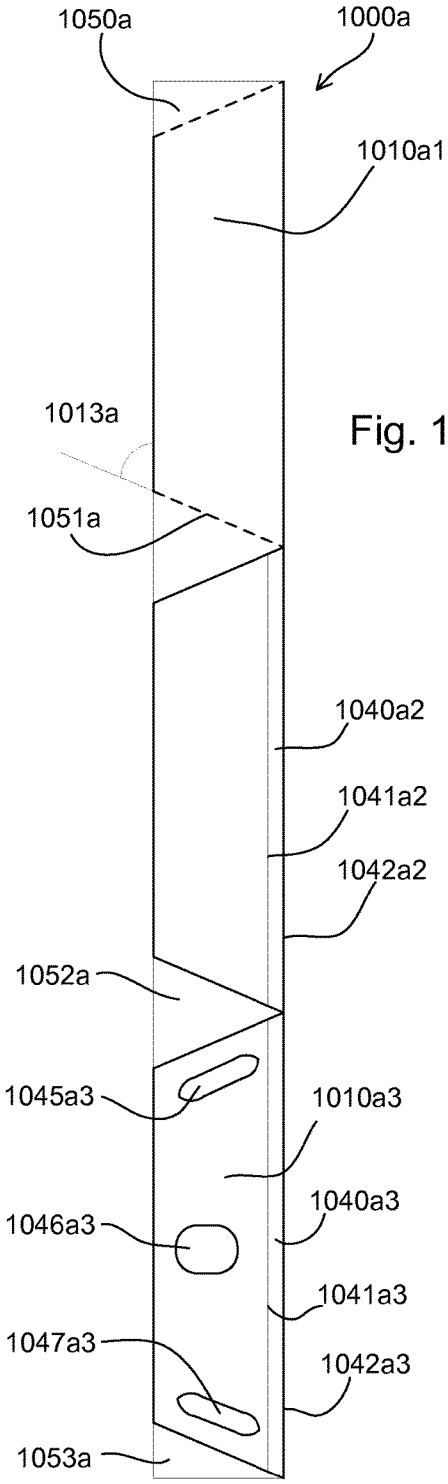
FIG. 10A depicts an example progression of manufacturing a blade for use in the safety utility knife assembly of FIGS. 9A-9H and 9J.
Figure 10B:
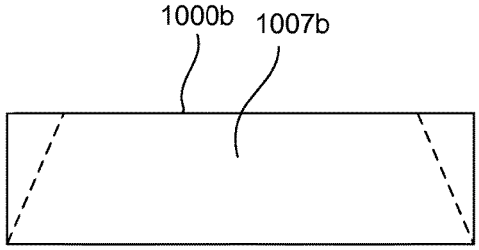
FIGS. 10B-10D depict a second example progression of manufacturing a blade for use in the safety utility knife assembly of FIGS. 9A-9H and 9J.
Figure 10C:
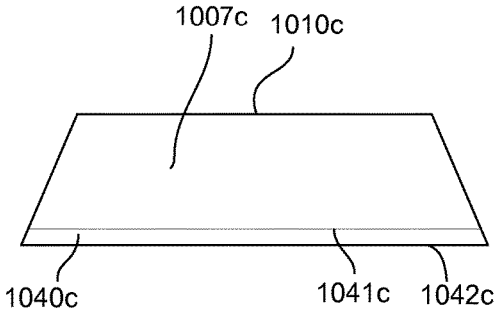
Figure 10D:
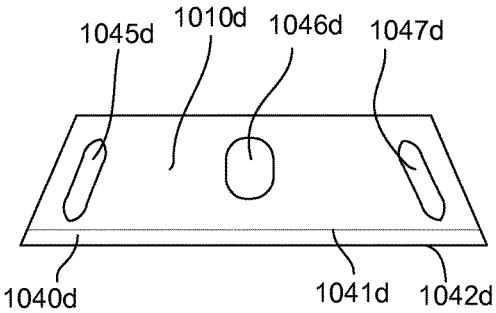
Figure 10E:
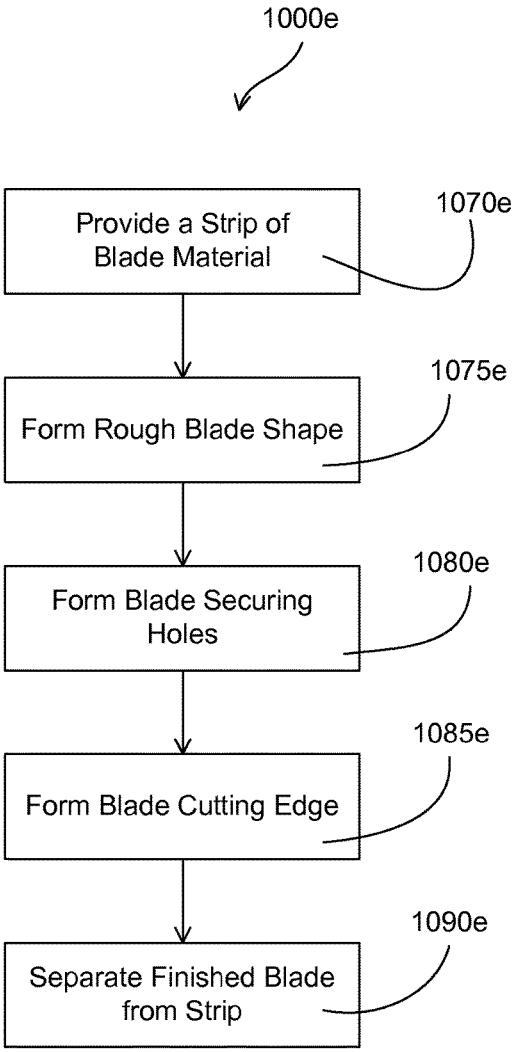
FIG. 10E depicts an example flow diagram for a method of manufacturing the safety blade of FIG. 10A.
Figure 10F:
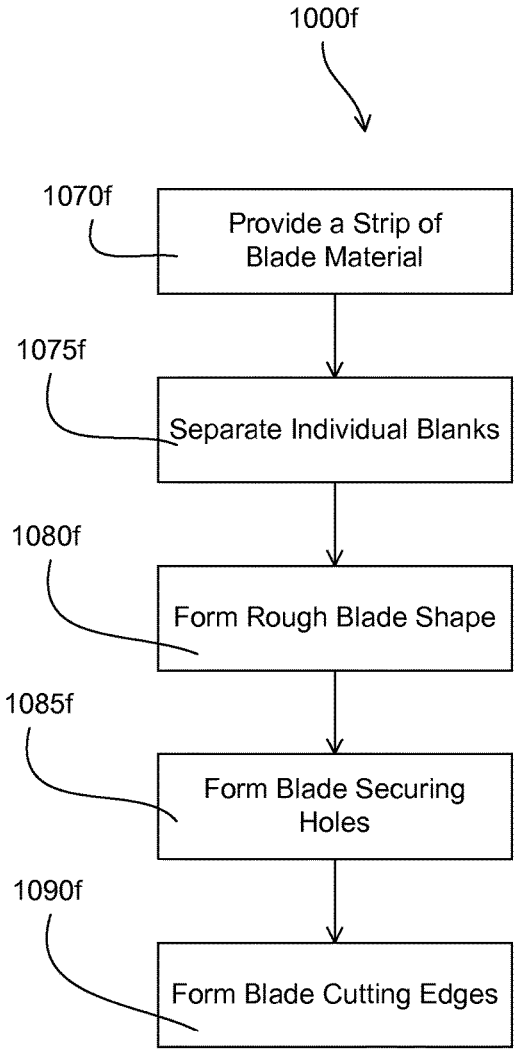
FIG. 10F depicts an example flow diagram for a method of manufacturing the safety blade of FIGS. 10B-10D.

Turning to FIGS. 10A and 10E, a method 1000*e* of manufacturing a blade 1010*a*3 for use in a safety utility knife assembly (e.g. safety utility knife assembly 800*a* of FIG. 8A) may include providing a strip of blade material 1000*a* (block 1070*e*). A rough blade shape 1010*a*1 may be formed by removing material 1050*a* (block 1075*e*). Blade securing holes 1045*a*3, 1046*a*3, 1047*a*3 may be formed in the rough blade shape 1010*a*1 by any suitable method, such as laser cutting, water jet cutting, machining, drilling, stamp shearing, etc. (block 1080*e*). A sharpened portion 1040*a*2, 1040*a*3 may be formed by any suitable method, such as those disclosed in U.S. Pat. No. 4,265,055, 5,842,387, 6,860,796 or 8,206,199, for example (block 1085*e*). The sharpened portion 1040*a*2, 1040*a*3 may define a shoulder 1041*a*2, 1041*a*3 and a cutting edge 1042*a*2, 1042*a*3. The blade 1010*a*3 may be separated from the strip of blade material 1000*a* by removing material 1052*a*, 1053*a* (block 1090*e*). A blade end 1051*a* may form an angle 1013*a* with respect to a linear edge of the strip of blade material 1000*a* of approximately 60°. The angle 1013*a* may be between approximately 55° and approximately 70°.

With reference now to FIGS. 10B-10D and 10F, a method 1000*f* of manufacturing a blade 1010*d* for use in a safety utility knife assembly (e.g. safety utility knife assembly 800*a* of FIG. 8A) may include providing a strip of blade material 1000*a* (block 1070*f*). Blade blanks 1000*b* may be formed from the strip of blade material 1000*a* (block 1075*f*). Rough blade shapes 1007*b* may be formed from the blade blanks 1000*b* (block 1080*f*). Blade securing holes 1045*b*, 1046*b*, 1047*b* may be formed in the rough blade shape 1000*b* by any suitable method, such as laser cutting, water jet cutting, machining, drilling, stamp shearing, etc. (block 1085*f*). A sharpened portion 1040*c*, 1040*d* may be formed by any suitable method, such as those disclosed in U.S. Pat. No. 4,265,055, 5,842,387, 6,860,796 or 8,206,199, for example (block 1090*f*). The sharpened portion 1040*c*, 1040*d* may define a shoulder 1041*c*, 1041*d* and a cutting edge 1042*c*, 1042*c*.

Figure 8A:
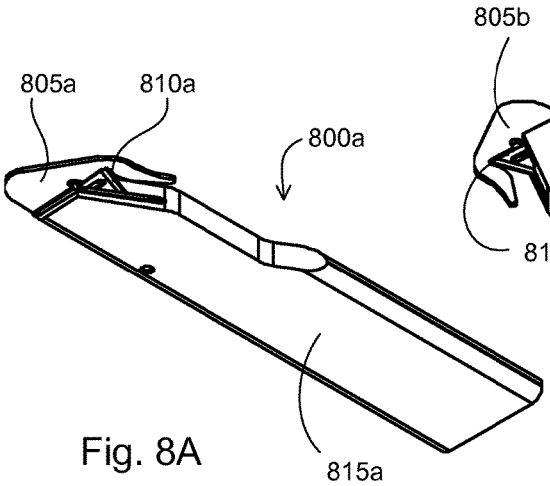
FIGS. 8A-8H and 8J-8K depict an example safety utility knife assembly.
Figure 8B:
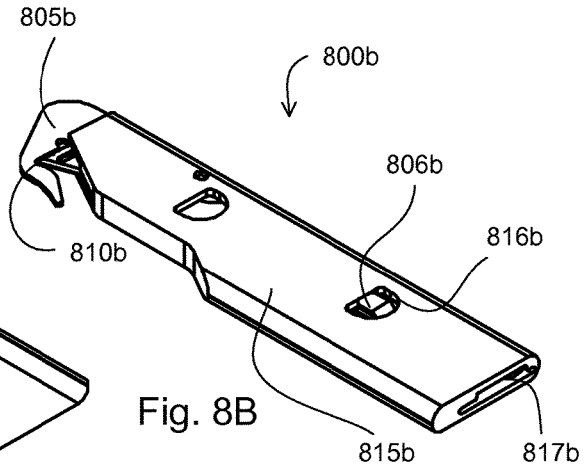
Figure 8C:
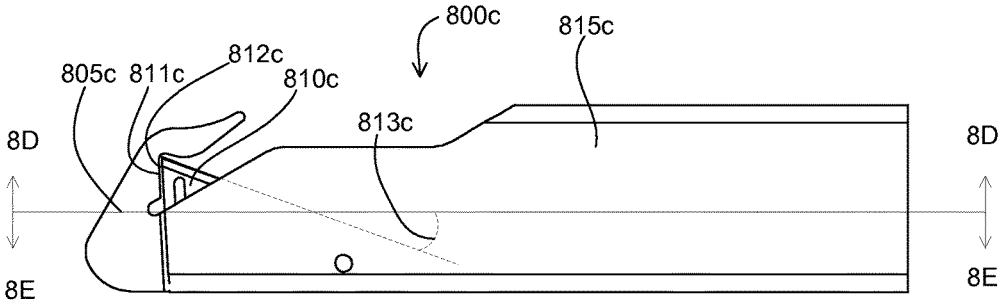
Figure 8D:
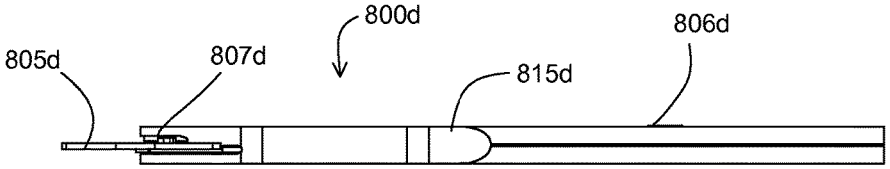
Figure 8E:
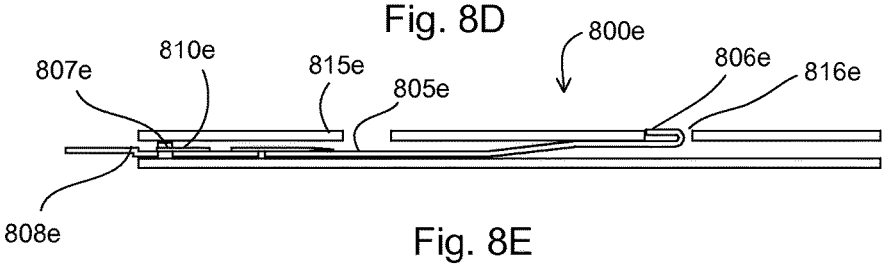
Figure 8F:
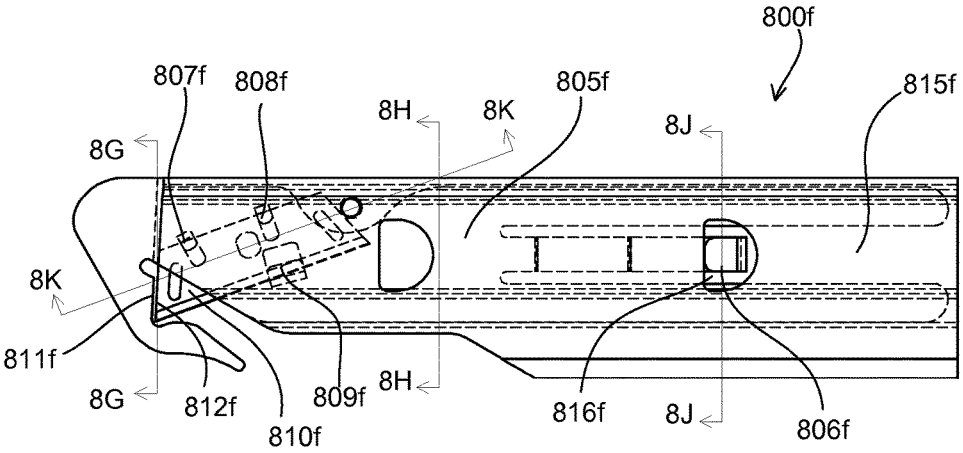
Figure 8G:
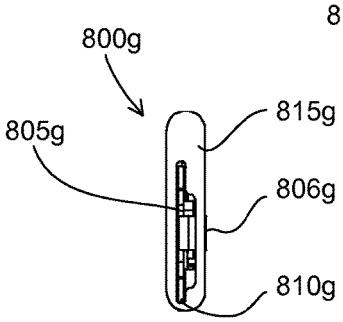
Figure 8H:
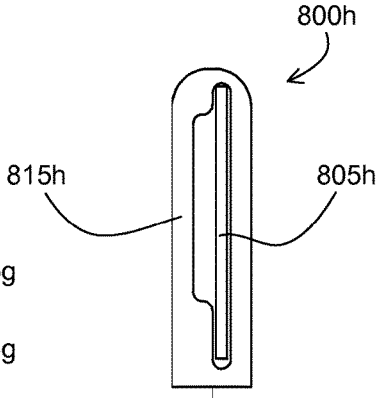
Figure 8J:
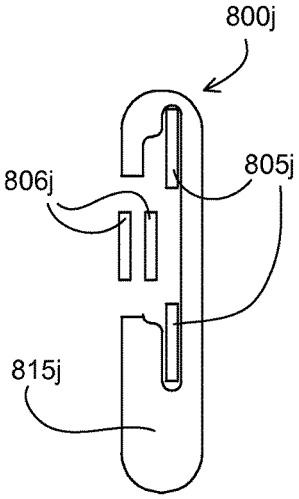
Figure 8K:
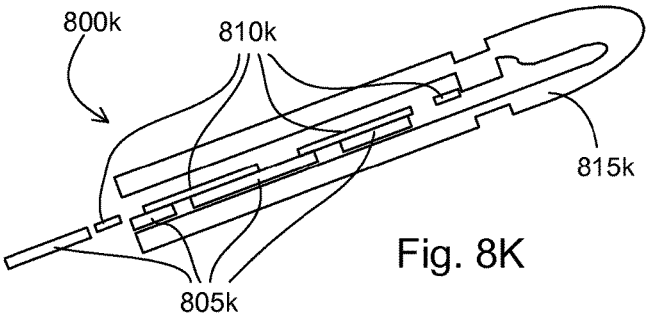
Figure 11:
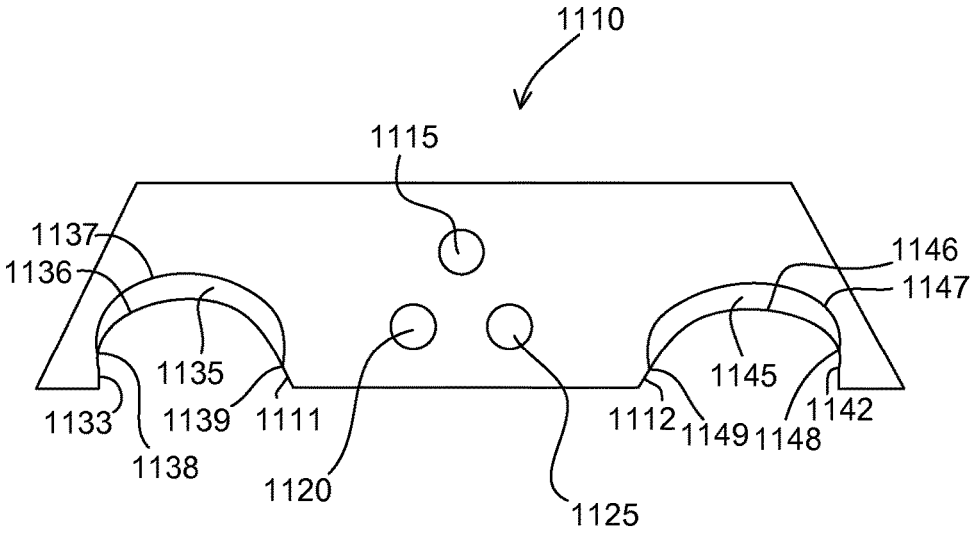
FIG. 11 depicts an example safety utility blade for use in a safety utility knife assembly as in FIGS. 9A-9H and 9J.

With reference to FIG. 11, a safety utility blade 1110 for use in the safety utility knife assembly 800*a* of FIG. 8A may have a body 1110*a* formed from a relatively thin and substantially flat material 1000*a*, such as ceramic, heat treated carbon steel, ceramic coated steel, stainless steel, Teflon coated material, etc. For example, the material 1000*a* may be approximately 0.025 inches thick. A blade blank (e.g. blade blank 1000*a*, 1000*b* of FIGS. 10A and 10B, respectively) may be 1.0964567 inches from a first end 1050*a* to a second end 1051*a* and 0.3917323 inches from a top side 1010*c* to a bottom side 1042*d*. The safety utility blade may include blade securing holes 1115, 1120, 1125. As described herein the blade securing holes 1115, 1120, 1125 may, at least in part, secure a safety utility blade 1110 to a safety utility knife cutting head (e.g., safety utility knife cutting head 920*j* of FIG. 9J). The safety utility blade 1110 may be formed from a suitable material 1000*a* for retaining a sharpened edge 1136, 1137, and, when that material 1000*a* is metal, the body 1110*a* preferably has a thickness 106*b* of at least 0.0156 inches and preferably not greater than about 0.0313 inches. What might be characterized as a "heavy-duty" safety utility blade 100 is approximately 0.025 inches thick, and the thickness 106*b* for what might be characterized as a "regular duty" safety utility blade 1110 is approximately 0.017 inches. The sharpened portion 1135, 1145 is approximately 0.0492 inches high.

With further reference to FIG. 11, the first sharpened portion 1135 of the safety utility blade 1110 may include a first shoulder 1137, a first cutting edge 1136, a first heel 1139 and a first toe 1138. The safety utility blade may include a first edge 1111 extending from the first heel 1139 to the bottom side. The safety utility blade 1110 may further include a first inner edge 1133 that extends from the first toe 1139 to the bottom side and may have a thickness that is greater than the first sharpened portion 1135 and less than or equal to the thickness 106*b* of the body 1005*a*. The first edge 1111 and the first inner edge 1133 may cooperate to limit access to the cutting edge 1136 while the safety utility blade 1110 is being used in the safety utility knife assembly 800*a*, while the safety utility blade 1110 is being inserted into the safety utility knife assembly 800*a*, while the safety utility blade 1110 is being removed from the safety utility knife assembly 800*a* and while the safety utility blade 1110 is being handled while removed from the safety utility knife assembly 800*a*.

With further reference to FIG. 11, the safety utility blade 1110 may include a second sharpened portion 1145 which may include a second shoulder 1147, a second cutting edge 1146, a second heel 1149 and a second toe 1148. The safety utility blade 1110, 110*b* may include a second edge 1112 extending from the second heel 1149 to the bottom side. The safety utility blade 1110 may further include a second inner edge 1143 that extends from the second toe 1149 to the bottom side and may have a thickness that is greater than the second sharpened portion 1145 and less than or equal to the thickness 106*b* of the body 1005*a*. As depicted in FIG. 1*b*, the cutting edge 136*b* may be defined by a third sharpened portion 135*b*1 extending from a third shoulder 137*b*1 and a fourth sharpened portion 135*b*2 extending from a fourth shoulder 137*b*2. It should be understood that either of the cutting edges 1136, 1146 may be formed similar to cutting edge 136*b*. The second edge 1112 and the second inner edge 1143 may cooperate to limit access to the cutting edge 1146 while the safety utility blade 1110 is being used in the safety utility knife assembly 800*a*, while the safety utility blade 1110 is being inserted into the safety utility knife assembly 800*a*, while the safety utility blade 1110 is being removed from the safety utility knife assembly 800*a* and while the safety utility blade 1110 is being handled while removed from the safety utility knife assembly 800*a*. A safety utility blade 1110 may be manufactured similar to the safety utility blade 100 as described with reference to FIGS. 3A-3E and 4A-4D.

The figures depict preferred embodiments of safety blades for use in utility knife assemblies, utility knife assemblies and methods of manufacturing. One skilled in the art will readily recognize from the corresponding written description that alternative embodiments of the structures and methods illustrated herein may be employed without departing from the principles described.

Upon reading this disclosure, those of skill in the art will appreciate still additional alternative structural and functional designs for safety blades for use in utility knife assemblies, utility knife assemblies and methods of manufacturing. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the apparatuses and methods disclosed herein without departing from the spirit and scope defined in the appended claims.

What is claimed is:

1. A replaceable safety blade for use within a utility knife assembly having a handle with a cutting head engagement portion, the replaceable safety blade comprising:

a blade body, a blade attachment having a first inner edge and a second inner edge, a first blade shield, a second blade shield, a first blade cutting edge, and a second blade cutting edge, wherein the blade body, the blade attachment, the first blade shield, the second blade shield, the first blade cutting edge, and the second blade cutting edge compose a contiguous piece of metal, wherein the first blade cutting edge is positioned between the first blade shield and the first inner edge, and the second blade cutting edge is positioned between the second blade shield and the second inner edge, wherein the blade attachment further includes a bottom edge extending between the first inner edge of the blade attachment and the second inner edge of the blade attachment defining a width of the blade attachment;

a handle adaptor having a body portion and a handle engagement portion with a handle securing mechanism, wherein the handle engagement portion is extended from the body portion and is configured to removably secure to the cutting head engagement portion of the handle, wherein the handle engagement portion extends from a bottom edge of the body portion, and wherein the bottom edge of the body portion has a width approximately equal to the width of the bottom edge of the blade attachment;

the first blade shield and the first inner edge of the blade attachment form a first blade throat which limits exposure to the first blade cutting edge, wherein the first blade shield comprises a first blunt tip having a first inner edge with a thickness that is greater than a thickness of the first blade cutting edge and less than or substantially equal to the thickness of the blade body and wherein the first inner edge of the blade attachment and the first inner edge of the first blunt tip extend beyond the first blade cutting edge; and the second blade shield and the second inner edge of the blade attachment form a second blade throat which limits exposure to the second blade cutting edge, wherein the second blade shield comprises a second blunt tip having a thickness that is greater than a thickness of the second blade cutting edge and less than or substantially equal to the thickness of the blade body and wherein the second inner edge of the blade attachment and the second inner edge of the second blunt tip extend beyond the second blade cutting edge.

2. The safety blade as in claim 1 wherein the first inner edge of the blade attachment forms an angle with respect to a bottom of the safety blade to encourage material being cut to move toward the first blade cutting edge.

3. The safety blade as in claim 1 wherein an inner edge of the blade shield extends from a first toe of the first blade cutting edge to the first blunt tip.

4. The safety blade as in claim 1 wherein the first inner edge of the blade attachment extends from a heel of the first blade cutting edge to a bottom of the safety blade.

5. The safety blade as in claim 1 wherein the contiguous piece of metal is selected from the group consisting of: heat treated metal, heat treated carbon steel and stainless steel.

6. The safety blade as in claim 1 wherein the first blade cutting edge has a triangular shaped cross section.

7. The safety blade as in claim 1 wherein the first blunt tip has a radius approximately 0.03937 inches, and a thickness of greater than 0.017 inches and not greater than about 0.0313 inches.

* * * * *